US006547241B2

(12) United States Patent
Yoshida et al.

(10) Patent No.: US 6,547,241 B2
(45) Date of Patent: Apr. 15, 2003

(54) CARRYING DIRECTION CHANGING APPARATUS FOR DOCUMENT AND THE LIKE

(75) Inventors: Kazushi Yoshida, Chiyoda-cho (JP); Riichi Kato, Nagoya (JP); Yasunari Niioka, Seto (JP); Shinji Shibata, Nagoya (JP)

(73) Assignee: Hitachi, Ltd., Tokyo (JP)

( * ) Notice: Subject to any disclaimer, the term of this patent is extended or adjusted under 35 U.S.C. 154(b) by 85 days.

(21) Appl. No.: 09/845,187

(22) Filed: May 1, 2001

(65) Prior Publication Data

US 2002/0014737 A1 Feb. 7, 2002

(30) Foreign Application Priority Data

May 12, 2000 (JP) ..... 2000-144587

(51) Int. Cl.[7] ..... B65H 39/10
(52) U.S. Cl. ..... 271/303
(58) Field of Search ..... 271/303, 184

(56) References Cited

U.S. PATENT DOCUMENTS 5,228,681 A * 7/1993 Arnold ..... 271/303
5,263,708 A * 11/1993 Hacknauer ..... 271/303
6,196,464 B1 * 3/2001 Patterson et al. ..... 271/303 X

FOREIGN PATENT DOCUMENTS

JP 59-230955 A * 12/1984 ..... 271/303
JP 4-308149 A * 10/1992 ..... 271/303
JP 11-171386 A * 6/1999

* cited by examiner

*Primary Examiner*—David H. Bollinger
(74) *Attorney, Agent, or Firm*—Antonelli, Terry, Stout & Kraus, LLP

(57) ABSTRACT

There is provided a carrying direction changing apparatus of a compact and highly-reliable design capable of changing a carrying direction of documents or the like to three directions. The apparatus includes one gate device having a function of changing the carrying direction from one carrying path to another carrying path while carrying and guiding the documents, a rotation shaft having the gate device fixedly mounted thereon, a bracket fixedly mounted on the rotation shaft, a pin mounted on the bracket, a link device pivotally movable relative to the pin, a drive source connected to the link device so as to drive the gate device, a spring device connected at one end thereof to the bracket, a stop member device provided for contact with the bracket, a rotation shaft for enabling the stop member device to rotate, a pin mounted on the stop member device, a link device pivotally movable relative to this pin, and a drive source connected to this link device so as to drive the stop member device.

20 Claims, 3 Drawing Sheets

CARRYING DIRECTION CHANGING APPARATUS FOR DOCUMENT AND THE LIKE

BACKGROUND OF THE INVENTION

This invention relates to an apparatus for handling documents or the like, and more particularly to a carrying direction changing apparatus for changing a path of carrying of documents or the like such as bills (notes) and slips.

There is already known a carrying path-changing gate for changing a direction of carrying of bills or the like conveyed at high speed in an apparatus, and one such technique is disclosed, for example, in JP-A-11-171386. This technique is characterized in that with respect to a solenoid for driving a change-over gate, an impact is absorbed by a stopper, thereby obviating the use of rubber. A technique of moving bills in a first direction or a second direction is disclosed as a control for switching a gate in accordance with the driving of a solenoid.

SUMMARY OF THE INVENTION

One example of carrying direction changing apparatuses for documents or the like is shown in FIG. 4. In this apparatus, the direction of carrying of the documents, conveyed in a carrying path A, is changed to one of two directions, that is, a carrying path B and a carrying path C. This apparatus comprises a gate body 101 (serving as gate means) for changing the carrying direction from the carrying path A to the carrying path B or the carrying path C while carrying and guiding the documents, a rotation shaft 102 (serving as support means) on which the gate body 101 is fixedly mounted, links (forming a link mechanism) 103, 104 and 105 connected to the rotation shaft so as to rotate this rotation shaft by a predetermined angle necessary for changing the carrying direction, solenoid means 106 (serving as a drive source) and spring means 107 for driving the link mechanism, and stop means (not shown) for stopping the rotation shaft at the predetermined angle.

In this document carrying direction changing apparatus, when the documents are to be transferred from the carrying path A to the carrying path B, a predetermined voltage is applied to the solenoid 106 to drive the same so as to move the gate body 101 into a position indicated in a solid line in FIG. 4. When the documents are to be transferred from the carrying path A to the carrying path C, a voltage is not applied to the solenoid 106, so that the gate body 101 is rotated in a reverse direction under the influence of the spring 107, and is held in a position, indicated by a broken line in FIG. 4, by the stop means. In this manner, the carrying direction of the documents can be changed to the two directions.

FIG. 5 shows a known apparatus for changing a carrying direction of documents to three directions. In this apparatus, the carrying direction is changed from a carrying path A to a carrying path B or a carrying path C, or from the carrying path B to the carrying path A or the carrying path C while carrying and guiding the documents. This apparatus comprises a gate body 101 for changing the carrying direction while carrying and guiding the documents, a rotation shaft 102 having this gate body 101 fixedly mounted thereon, and a stepping motor 108 (serving as a drive source) connected to this rotation shaft 102.

In this apparatus for changing the document-carrying direction to the three directions, in order that the gate body 101 can be moved into each required position so as to change the carrying path, the number of steps of stepping motor 108 is beforehand controlled to obtain a predetermined angle, and the stepping motor is driven to change the carrying direction of the documents.

In the first example, the carrying direction of the documents can be changed only to the two directions. Therefore, in order that the carrying direction of the documents can be changed to three directions, another carrying path-changing apparatus of a similar construction is needed, and this would invite a problem that the changing mechanism becomes large in size. There may be encountered another problem that even if only the gate body is formed into such a shape as to be able to carry and guide the documents in three directions, the gate body can not be stopped at three positions.

In the second example of apparatus for changing the carrying path to the three directions, the carrying direction of the documents can be changed to the three directions. However, the stepping motor is used as the drive source, and therefore when the speed of the changing operation is high, there are encountered problems that a step-out occurs when the gate body is driven, that the control for rotating (angularly move) the gate body through the predetermined angle is difficult, so that an error in the carrying direction changing operation for the documents occurs at the changing portion, and that the jamming due to an improper changing operation is liable to occur. And besides, the stepping motor must always be energized in order to stop the gate body at the predetermined position, and this is a problem from an energy-saving point of view.

According to the present invention, there is provided a carrying direction changing apparatus comprising one gate means having a function of changing the carrying direction from one carrying path to another carrying path while carrying and guiding the documents, rotation shaft means having the gate means fixedly mounted thereon, a bracket fixedly mounted on the rotation shaft means, a pin mounted on the bracket, link means pivotally movable relative to the pin, a drive source connected to the link means so as to drive the gate means, spring means connected at one end thereof to the bracket, stop member means provided for contact with the bracket, rotation shaft means for enabling the stop member to rotate, a pin mounted on the stop member means, link means pivotally movable relative to this pin, and a drive source connected to this link means so as to drive the stop member means.

DESCRIPTION OF THE PREFERRED EMBODIMENTS

A preferred embodiment of the present invention will now be described in detail with reference to the drawings.

Figure 1:
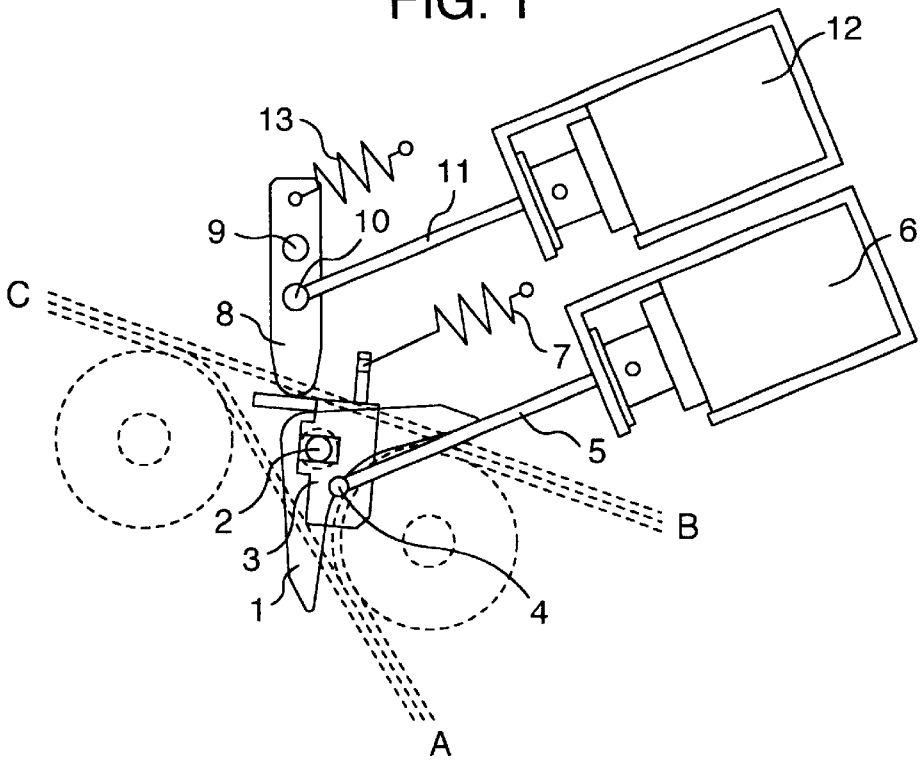
FIG. 1 is a view showing one mode of an operation of a document carrying direction changing apparatus according to the present invention.

FIG. 1 shows one preferred embodiment of a carrying direction changing apparatus for documents or the like according to the invention. In this embodiment, there are shown an operation for changing a document-carrying direction from a first document-carrying path A to a second document-carrying path B, an operation for changing the document-carrying direction from the first carrying path A to a third carrying path C, an operation for changing the document-carrying direction from the second carrying path B to the first carrying path A, and an operation for changing the document-carrying direction from the carrying path B to the third carrying path C, and these carrying paths A, B and C are formed by belts and rollers indicated in broken lines in FIG. 1.

The document carrying direction changing apparatus of this embodiment comprises a gate body 1 (serving as a single gate means) having a function of changing the carrying direction from one carrying path to another carrying path while carrying and guiding the documents, a rotation shaft 2 having the gate body 1 fixedly mounted thereon, a bracket 3 fixedly mounted on the rotation shaft 2, a pin 4 mounted on a portion of the bracket 3, a link 5 pivotally movable relative to the pin 4, a solenoid 6 (serving as a drive source) connected to the link 5 so as to drive the gate body 1, a coil spring 7, which is connected at one end thereof to a portion of the bracket 3 and also is connected at the other end thereof to a frame (not shown), a stop member 8 provided for contact with a portion of the bracket 3, a rotation shaft 9 for enabling the stop member 8 to rotate (angularly move), a pin 10 mounted on a portion of the stop member 8, a link 11 pivotally movable relative to the pin 10, a solenoid 12 (serving as a drive source) connected to the link 11 so as to drive the stop member 8, and a coil spring 13 which is connected at one end thereof to a portion of the stop member 8, and is also connected at the other end thereof to the frame (not shown).

Next, the operation of the document carrying direction changing apparatus of this embodiment will be described.

When the documents are to be transferred from the carrying path A to the carrying path B, the gate body 1 of the carrying direction changing apparatus is stopped at a position indicated in a solid line in FIG. 1. At this time, the solenoid 6 for driving the gate body 1 and the solenoid 12 for driving the stop member 8 are not energized. Therefore, only a clockwise (in the drawings) moment acts on the gate body 1 under the influence of the coil spring 7, so that the gate body 1 tends to rotate (angularly move) in a clockwise direction about the axis of the rotation shaft 2.

On the other hand, at this time, the solenoid 12 for driving the stop member 8 is also not energized, and therefore only a clockwise (in the drawings) moment acts on the stop member 8 under the influence of the coil spring 13, so that the stop member 8 rotates (angularly moves) in a clockwise direction about the axis of the rotation shaft 9, and is stopped at a position, shown in FIG. 1, by a stopper (not shown).

The stop member 8 is thus stopped at the position shown in FIG. 1, and therefore the portion of the bracket 3, mounted on the rotation shaft 2 rotatable together with the gate body 1, contacts the stop member 8, and therefore the bracket 3 can not rotate, so that the gate body 1 is stopped at the position shown in FIG. 1. The bracket 3 has such a shape as to contact the stop member 8.

Figure 2:
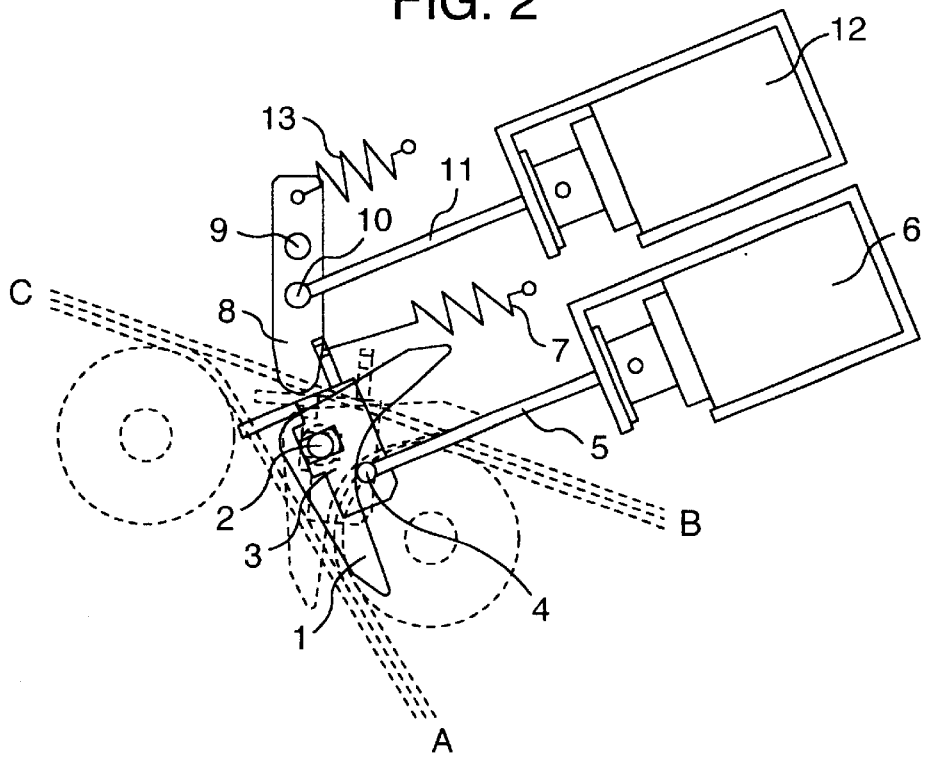
FIG. 2 is a view showing another mode of the operation of the document carrying direction changing apparatus in FIG. 1.

When the documents are to be transferred from the carrying path A to the carrying path C, the gate body 1 of the carrying direction changing apparatus is stopped at a position indicated in a solid line in FIG. 2. At this time, the solenoid 6 for driving the gate body 1 is energized to drive this gate body 1, but the solenoid 12 for driving the stop member 8 is not energized. Therefore, a counterclockwise (in the drawings) moment, overcoming the resilient force of the coil spring 7, acts on the gate body 1, and the gate body 1 is rotated in a counterclockwise direction about the axis of the rotation shaft 2, and is stopped at the position, indicated in the solid line in FIG. 2, by a stopper (not shown).

On the other hand, at this time, the solenoid 12 for driving the stop member 8 is not energized, and therefore as described above for FIG. 1, only the clockwise (in the drawings) moment acts on the stop member 8 under the influence of the coil spring 13, so that the stop member 8 rotates (angularly moves) in the clockwise direction about the axis of the rotation shaft 9, and is kept stopped at the position, shown in FIG. 2, by the stopper (not shown).

The stop member 8 is thus kept stopped at the position shown in FIG. 2, and also the bracket 3, mounted on the rotation shaft 2 rotatable together with the gate body 1, is thus rotated in the counterclockwise direction, and therefore the bracket 3 will not be brought into contact with the stop member 8.

Figure 3:
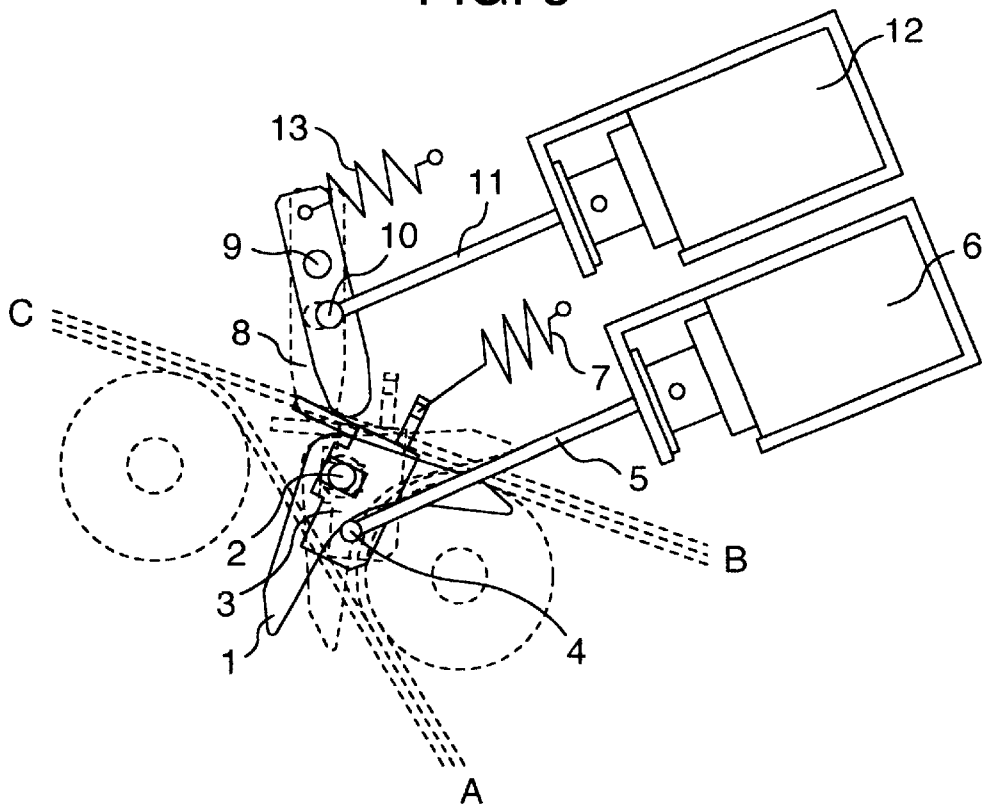
FIG. 3 is a view showing a further mode of the operation of the document carrying direction changing apparatus in FIG. 1.
Figure 4:
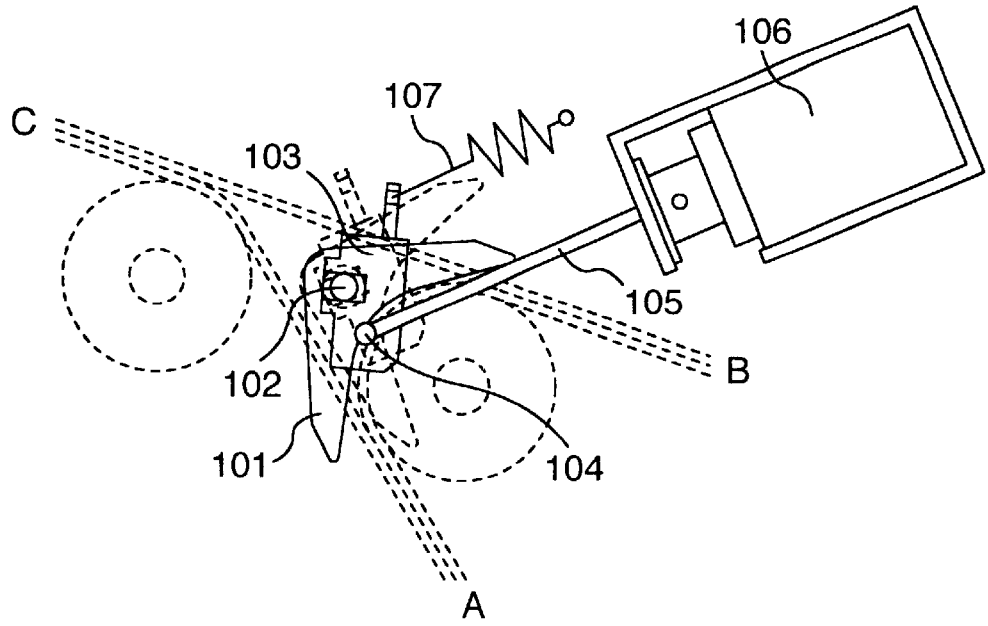
FIG. 4 is a view showing an apparatus for changing a document-carrying direction to two directions.
Figure 5:
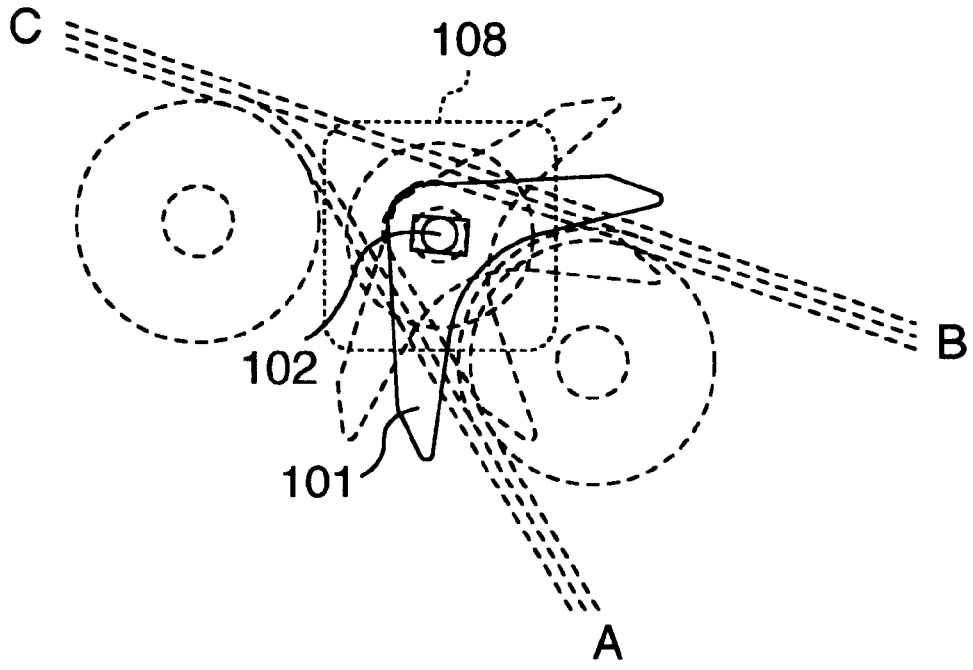
FIG. 5 is a view showing an apparatus for changing a document-carrying direction to three directions.

When the documents are to be transferred from the carrying path B to the carrying path C, the gate body 1 of the carrying direction changing apparatus is stopped at a position indicated in a solid line in FIG. 3. At this time, the solenoid 6 for driving the gate body 1 is not energized, but the solenoid 12 for driving the stop member 8 is energized. Therefore, the clockwise (in the drawings) moment acts on the gate body 1 under the influence of the coil spring 7, so that the gate body 1 tends to rotate (angularly move) in the clockwise direction about the axis of the rotation shaft 2.

On the other hand, the solenoid 12 for driving the stop member 8 is also energized, and the counterclockwise (in the drawings) moment, overcoming the resilient force of the coil spring 13, acts on the stop member 8, and the stop member 8 is rotated in the counterclockwise direction about the axis of the rotation shaft 9, and is stopped at a position, indicated in a solid line in FIG. 3, by the stopper (not shown).

The stop member 8 is thus rotated into the position shown in FIG. 3, and is stopped there, and therefore the gate body 1 is much rotated clockwise from the position shown in FIG. 1. Then, the portion of the bracket 3, mounted on the rotation shaft 2, contacts the stop member 8, thereby stopping the gate body 1 at the position shown in FIG. 1. As described above for FIG. 1, the bracket 3 has such a shape as to contact the stop member 8.

When the documents are to be transferred from the carrying path B to the carrying path A, the gate is disposed at the same position as described above for transferring the documents from the carrying path A to the carrying path B, and the gate body 1 of the carrying direction changing apparatus is stopped at the position indicated in the solid line in FIG. 1. The operation of the gate is the same as described above for FIG. 1, and explanation thereof is omitted here.

By driving the changing apparatus of the above construction as described above, the document-carrying direction can be changed to the three directions. The carrying paths A, B and C can carry the documents in the forward and reverse directions.

Such constituent parts (including the gate means and the rotation shaft means) as illustrated in this embodiment are not limited to the illustrated means, but can be replaced by corresponding means in so far as such means perform similar functions.

According to the present invention described above in detail, there can be provided the carrying direction changing apparatus of a compact and highly-reliable design capable of changing the carrying direction of the documents or the like to the three directions.

What is claimed is:

1. A carrying direction changing apparatus for changing a direction of carrying of documents, comprising gate means having a function of changing the carrying direction from one carrying path to another carrying path while carrying and guiding the documents, support means supporting said gate means, drive means for rotating said support means so as to rotate said gate means about an axis of said support means, and stop means for stopping said support means at three positions so as to change the carrying direction of the documents;

wherein an operation for changing the document-carrying direction from a first carrying path to a second carrying path, an operation for changing the document-carrying direction from said first carrying path to a third carrying path, an operation for changing the document-carrying direction from said second carrying path to said first carrying path, and an operation for changing the document-carrying direction from said second carrying path to said third carrying path can be effected.

2. Apparatus according to claim 1, in which at least two of said first, second and third carrying paths have carrying means capable of carrying the documents in two directions.

3. Apparatus according to claim 2, further comprising another drive means for rotating and driving said stop means, wherein said drive means for driving said support means and said another drive means for driving said stop means control said support means and said stop means independently of each other.

4. Apparatus according to claim 1, further comprising another drive means for rotating and driving said stop means, wherein said drive means for driving said support means and said another drive means for driving said stop means control said support means and said stop means independently of each other.

5. Apparatus according to claim 1, in which when the documents are to be transferred from said first carrying path to said second carrying path and when the documents are to be transferred from said second carrying path to said first carrying path, said drive means for driving said support means and said another drive means for driving said stop means are deactivated.

6. Apparatus according to claim 5, in which when the documents are to be transferred from said first carrying path to said third carrying path, said drive means for driving said support means is activated while said another drive means for driving said stop means is deactivated.

7. Apparatus according to claim 6, in which when the documents are to be transferred from said second carrying path to said third carrying path, said drive means for driving said support means is deactivated while said another drive means for driving said stop means is activated.

8. Apparatus according to claim 5, in which when the documents are to be transferred from said second carrying path to said third carrying path, said drive means for driving said support means is deactivated while said another drive means for driving said stop means is activated.

9. Apparatus according to claim 1, in which when the documents are to be transferred from said first carrying path to said third carrying path, said drive means for driving said support means is activated while said another drive means for driving said stop means is deactivated.

10. Apparatus according to claim 1, in which when the documents are to be transferred from said second carrying path to said third carrying path, said drive means for driving said support means is deactivated while said another drive means for driving said stop means is activated.

11. Apparatus for changing a direction of carrying of documents, comprising:

a first carrying path, a second carrying path and a third carrying path for carrying the documents;

gate means for changing the carrying direction of the documents, said gate means being provided at a position where said first, second and third carrying paths are connected together;

stop means for stopping said gate means at three positions in accordance with the carrying direction of the documents; and drive means for driving said gate means and said stop means.

12. Apparatus according to claim 11, in which the carrying direction of the documents includes a direction of carrying of the documents from said first carrying path to said second carrying path, a direction of carrying of the documents from said first carrying path to said third carrying path, and a direction of carrying of the documents from said second carrying path to said third carrying path.

13. Apparatus according to claim 12, in which when the documents are to be transferred from said first carrying path to said third carrying path, said drive means effects the driving of said gate means, and stops the driving of said stop means.

14. Apparatus according to claim 12, in which when the documents are to be transferred from said second carrying path to said third carrying path, said drive means stops the driving of said gate means, and effects the driving of said stop means.

15. Apparatus according to claim 11, in which said drive means controls said gate means and said stop means independently of each other.

16. Apparatus according to claim 11, further comprising a rotation shaft supporting said gate means, wherein said gate means is rotated clockwise and counterclockwise about an axis of said rotation shaft, and is stopped at the three positions under the control of a drive function of said drive means and a stop function of said stop means.

17. Apparatus according to claim 11, in which at least two of said first, second and third carrying paths have a carrying path capable of carrying the documents in two directions.

18. Apparatus according to claim 11, in which when the documents are to be transferred from said first carrying path to said second carrying path and when the documents are to be transferred from said second carrying path to said first carrying path, said drive means stops the driving of said gate means and said stop means.

19. A carrying direction changing apparatus for changing a direction of carrying of documents, comprising:

gate means having a function of changing the carrying direction from one carrying path to another carrying path while carrying and guiding the documents;

first rotation shaft means having said gate means fixedly mounted thereon;

a bracket fixedly mounted on said first rotation shaft means;

a first pin mounted on said bracket;

first link means pivotally movable relative to said first pin;

a first drive source connected to said first link means so as to drive said gate means;

spring means connected at one end thereof to said bracket;

stop member means for contacting with said bracket;

second rotation shaft means for enabling said stop member to rotate;

a second pin mounted on said second rotation shaft means;

second link means pivotally movable relative to said second rotation shaft means; and a second drive source connected to said second link means so as to drive said stop member;

wherein an operation for changing the document-carrying direction from a first carrying path to a second carrying path, an operation for changing the document-carrying direction from said first carrying path to a third carrying path, and an operation for changing the document-carrying direction from said second carrying path to said third carrying path are effected.

20. Apparatus according to claim 19, in which at least two of said first, second and third carrying paths have a carrying path capable of carrying the documents in two directions.

* * * * *